US011682322B2

(12) United States Patent
Torgersen

(10) Patent No.: US 11,682,322 B2
(45) Date of Patent: Jun. 20, 2023

(54) DEVICE FOR TRACKING WEAR OF A GARMENT AND RELATED METHODS

(71) Applicant: Erik Torgersen, Cincinnati, OH (US)

(72) Inventor: Erik Torgersen, Cincinnati, OH (US)

(73) Assignee: Erik Torgersen, Cincinnati, OH (US)

( * ) Notice: Subject to any disclaimer, the term of this patent is extended or adjusted under 35 U.S.C. 154(b) by 3 days.

(21) Appl. No.: 17/307,575

(22) Filed: May 4, 2021

(65) Prior Publication Data

US 2021/0358334 A1 Nov. 18, 2021

Related U.S. Application Data

(60) Provisional application No. 63/023,305, filed on May 12, 2020.

(51) Int. Cl.

| | |
|---|---|
| ***G09F 3/02*** | (2006.01) |
| ***G09F 11/23*** | (2006.01) |
| ***G06M 1/00*** | (2006.01) |

(52) U.S. Cl.

CPC ..... *G09F 3/02* (2013.01); *G06M 1/00* (2013.01); *G09F 11/23* (2013.01); *G09F 2003/0282* (2013.01)

(58) Field of Classification Search

CPC ..... G09D 3/08; G09D 3/04; A41B 11/002; D06F 95/008; Y10S 24/29; A47G 25/1428; G09F 2003/0282; G09F 11/23; G09F 3/02; G06M 1/00

See application file for complete search history.

(56) References Cited

U.S. PATENT DOCUMENTS

| | | | | |
|---|---|---|---|---|
| 26,817 A * | 1/1860 | Keplinger | G09D 3/08 | 40/113 |
| 41,605 A * | 2/1864 | Norman | G09D 3/08 | 40/113 |
| 56,470 A * | 7/1866 | Fulmer | G09D 3/08 | 40/113 |
| 241,088 A * | 5/1881 | Moeller | G09D 3/08 | 40/115 |
| 570,319 A * | 10/1896 | Reed | G09F 11/23 | 40/495 |
| 758,758 A * | 5/1904 | Biggs | G09D 3/08 | 40/115 |

(Continued)

OTHER PUBLICATIONS

Https://waitn.co/pages/crowd-counters, accessed Jul. 15, 2021.
Https://tallycounterstore, accessed Jul. 15, 2021.

*Primary Examiner* — David R Dunn
*Assistant Examiner* — Christopher E Veraa
(74) *Attorney, Agent, or Firm* — Frost Brown Todd LLP

(57) ABSTRACT

A device for tracking wear of a garment and related methods includes a counter body and an indicator. The counter body has a first indicia and a second indicia thereon. The indicator movably connects to the counter body and is configured to be selectively positioned relative to each of the first indicia and the second indicia for selectively aligning the indicator relative to the first indicia or the second indicia. The first indicia is different than the second indicia such that the indicator in alignment with the first indicia is configured to communicate a first wear state of the garment to a user and the indicator in alignment with the second indicia is configured to communicate a second wear state of the garment to the user.

17 Claims, 6 Drawing Sheets

(56) References Cited

U.S. PATENT DOCUMENTS 763,323 A * 6/1904 Reed ..... G09F 3/14 24/67 R
823,723 A * 6/1906 Guidinger ..... G09D 3/08 40/113
1,069,533 A * 8/1913 Davis ..... G09D 3/04 70/459
1,245,457 A * 11/1917 Gwynn ..... G09F 3/04 40/628
1,332,604 A * 3/1920 Chester ..... B42F 17/34 116/319
1,350,303 A * 8/1920 Elvyn ..... G09F 11/04 40/495
1,532,901 A * 4/1925 Humphrey ..... G09F 3/12 40/628
1,689,717 A * 10/1928 Clisson ..... G09F 3/12 40/657
1,721,076 A * 7/1929 Hirsh ..... G09F 3/00 40/657
1,849,039 A * 3/1932 Kennedy ..... G09F 3/14 40/662
2,169,552 A * 8/1939 Bellin ..... A47G 25/1428 D6/318
2,259,333 A * 10/1941 Park ..... G09D 3/08 40/115
2,431,645 A * 11/1947 Kamm ..... G09D 3/08 40/495
2,450,949 A * 10/1948 Gattuccio ..... A61J 7/04 116/315
2,453,955 A * 11/1948 Younghusband ..... A44C 9/00 63/15
2,748,514 A * 6/1956 Sulger ..... G09F 11/23 40/493
2,827,872 A * 3/1958 Thoma ..... B26B 21/4087 116/323
3,109,167 A * 10/1963 MacIntyre ..... G08B 5/30 340/319
3,124,284 A * 3/1964 Collum ..... A47G 25/1407 40/322
3,633,294 A * 1/1972 Burmeister ..... A41D 27/00 434/395
3,699,617 A * 10/1972 Hofmeister ..... A44B 99/00 24/578.13
4,224,894 A * 9/1980 Haldemann ..... G09F 11/23 40/495
4,679,340 A * 7/1987 Johansson ..... A47G 25/1428 40/322
4,886,010 A * 12/1989 Stutzman ..... G09F 11/23 116/318
5,242,067 A * 9/1993 Garby ..... G09F 11/23 215/230
5,260,914 A * 11/1993 Roberts ..... G09F 11/04 116/318
5,330,244 A * 7/1994 Rodwell ..... A47G 25/1457 224/927
5,499,466 A * 3/1996 House ..... A47G 25/1428 40/322
5,564,361 A * 10/1996 Satterwhite ..... G09F 11/23 116/323
5,564,812 A * 10/1996 Berardi ..... H01H 9/161 362/23.04
5,778,818 A * 7/1998 Marshall ..... A61J 7/04 206/459.1
5,788,872 A * 8/1998 Uratani ..... B29C 33/428 249/103
5,797,624 A * 8/1998 Lang ..... G09F 3/10 280/741
6,003,467 A * 12/1999 Shelton-Ferrell ..... G09F 11/23 116/315
6,330,969 B1 * 12/2001 Villaraut ..... G06M 1/083 235/375
7,246,730 B2 * 7/2007 Russo ..... A47G 25/1407 235/114
8,627,584 B2 * 1/2014 Aiezza ..... G09F 3/14 40/322
9,480,354 B2 * 11/2016 Eden ..... A47G 25/1407
9,601,037 B1 * 3/2017 Ransom ..... A47G 25/1428
9,622,606 B1 * 4/2017 Rotello ..... A47G 25/1428
2011/0113659 A1 * 5/2011 Aiezza ..... G09F 3/14 40/642.02
2014/0317970 A1 * 10/2014 Moore ..... G09F 3/04 40/661

* cited by examiner

DEVICE FOR TRACKING WEAR OF A GARMENT AND RELATED METHODS

CROSS-REFERENCE TO RELATED APPLICATION

This application claims priority to U.S. Pat. App. No. 63/023,305, filed on May 12, 2020, entitled "Device for Tracking Wear of a Garment," which is hereby incorporated by reference herein in its entirety.

TECHNICAL FIELD

The present invention relates generally to devices and methods for assessing a laundered state of a garment.

BACKGROUND

Laundering garments such as pants, sweaters, sweatshirts, dresses, jackets, and suits either at home or commercially (e.g., dry-cleaning) is well-known to be essential for the maintenance of such garments by removing stains and killing micro-organisms that may have accumulated on such garments while being worn. Nevertheless, it is typically not necessary for garments to be laundered after each use or wear of the garment. For example, a garment may be worn by an individual during a first use or wear in which the garment is substantially unexposed to dirt, sweat, or other sources of stains and micro-organisms such that the garment may remain suitably clean for a second use or wear without requiring an intervening laundering. Thus, the individual may choose to simply return the garment to its storage location, such as a hanger, closet, drawer, and/or shelf, after the first use or wear for awaiting one or more subsequent uses or wears without laundering the garment between such uses or wears. Such practices of wearing garments multiple times before laundering them provides a significantly more sustainable alternative to unnecessarily laundering garments after each use or wear by reducing water and detergent usage. Individuals who employ such multiple-wear practices can also enjoy a corresponding cost-saving benefit from the reduction in water and detergent usage, as well as a time-saving benefit from performing the task of laundering less frequently. Moreover, less-frequent laundering of garments may avoid over-laundering such garments, which has been known to reduce the garments' useful life.

Individuals who employ multiple-wear practices typically must rely on their own memory and/or senses to determine when a garment is ready for laundering. For example, an individual may recall wearing the garment on a certain number of occasions and compare that number to the individual's preferred threshold number of wears for laundering to determine whether the garment is ready for laundering. However, this determination is dependent on the accuracy of the individual's memory, which may be unreliable particularly in cases where the garment is worn irregularly across a long period of time and/or in cases where the individual is attempting to keep track of uses of a large volume of different garments. Thus, the individual may further visually assess the garment for blemishes and/or olfactorily assess the garment for odors to determine whether the garment is ready for laundering. However, many individuals prefer to launder the garment prior to the presence of such blemishes or odors to prevent the blemishes or odors from occurring.

Accordingly, there is a need for a device for tracking wear of a garment that addresses the present challenges such as those discussed above.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
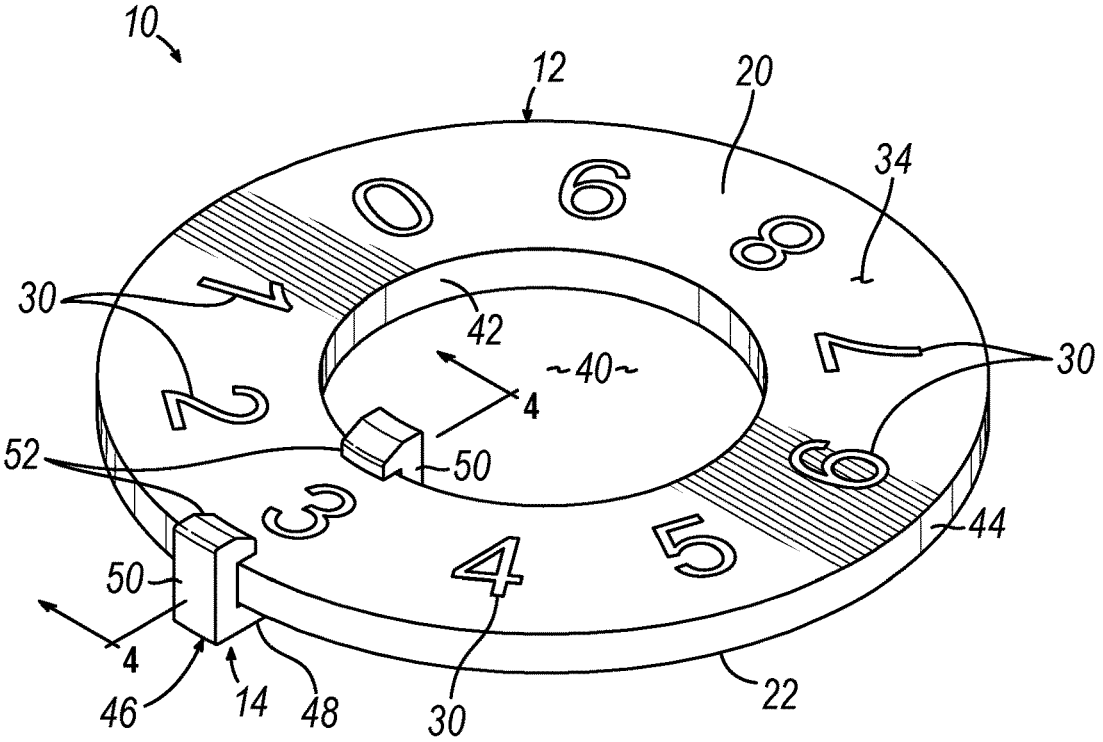
FIG. 1 depicts an upper perspective view of a first example of a wear counter having a first exemplary ring and a first exemplary slide.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It is further understood that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. Wear Counter for Tracking Garment Usage

A. First Example of a Wear Counter

FIGS. 1-4 shows a first example of a wear counter (10), which in the present example may also be referred to as a garment wear counter (10) for tracking garment usage as discussed below in greater detail. Wear counter (10) of the present example includes a first exemplary, generally annular ring body (12) and a first exemplary slide indicator (14) selectively slidably coupled to ring body (12). As described in greater detail below, wear counter (10) is configured to track a number of uses, which may also be referred to as respective wears, that an associated garment has experienced since the garment's most recent laundering to allow a user to quickly and reliably determine whether that garment is due to be laundered or may be worn as desired.

Figure 2:
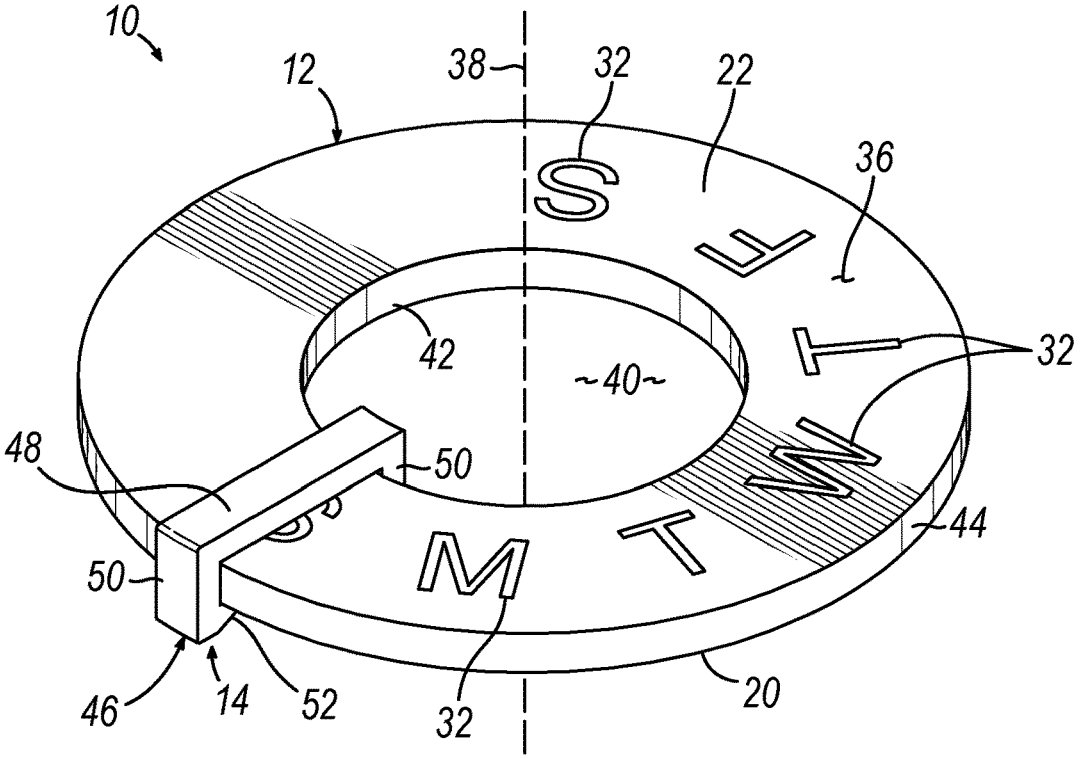
FIG. 2 depicts a lower perspective view of the wear counter of FIG. 1.

With respect to FIGS. 1-2, ring body (12) includes front and rear sides (20, 22) having pluralities of front and rear indicia (30, 32) arranged on front and rear surfaces (34, 36), respectively. While ring body (12) has front and rear indicia (30, 32) respectively on both front and rear sides (20, 22), such indicia (30, 32) may only be on one of such sides (20, 22) in alterative examples. In the present example, the plurality of front indicia (30) includes ten integers from "0" to "9," inclusive, arranged with uniform circumferential spacing about a central axis (38) of ring body (12) such that the integers increase incrementally in a counterclockwise direction. The plurality of rear indicia (32) includes seven letters arranged with uniform circumferential spacing about the central axis (38) of ring body (12) and between letters. More particularly the letters of rear indicia (32) include "S," "M," "T," "W," "T," "F," and "S," which respectively correspond with Sunday, Monday, Tuesday, Wednesday, Thursday, Friday, and Saturday of a calendar week. These letters of rear indicia (32) progress incrementally in a counterclockwise direction from Sunday to Saturday inclusive of the days of the calendar week. Such indicia (30, 32) may be printed on surfaces (34, 36), raised on surfaces (34, 36), or recessed relative to respective on surfaces (34, 36) on sides (20, 22). In the present example, at least some of letters of rear indicia (32) angularly align with opposing integers of front indicia (30) about the central axis (38) such that at least some of letters of rear indicia (32) share a common angular position on ring body (12). In another example, front indicia (30) may be angularly offset from, or misaligned with, rear indicia (32) such that each indicia (30, 32) occupies a respective, dedicated angular position on ring body (12) about the central axis (38) of ring body (12). In any case, slide indicator (14) is configured to be selectively repositioned about central axis (38) to align with any of front and/or rear indicia (30, 32) as desired by the user. For example, the user may align slide indicator (14) with integers of front indicia (30) as a garment is worn to count up with each respective wear or count down with each respective wear. By way of further example, the user may align slide indicator (14) with letters of rear indicia (32) to indicate a prior day on which a garment was last worn or last washed. The user may similarly align slide indicator (14) with letters of rear indicia (32) to indicate a future day on which a garment may be worn a final time as desired before washing.

Ring body (12) of the present example is singularly and unitarily formed, such as via an injection molding process, for example. In one example, ring body (12) is constructed of a relatively lightweight non-absorbent and/or water-proof material, such as nylon, for example. Ring body (12) of the present example also has an outer diameter large enough to enable visibility of indicia (30, 32) yet small enough to be attached to garments, even while being worn relatively unnoticed by the user. Such an outer diameter of ring body (12) in one example ranges from approximately 0.75 inches to approximately 2.0 inches and, more particularly, from approximately 1 inch to approximately 1.5 inches, such as approximately 1.125 inches, although the invention is not intended to be unnecessarily limited to such sizing. Moreover, it will be appreciated that alternative methods of manufacture other than injection molding may be used, and the invention is not intended to be unnecessarily limited to any particular manufacturing technique or construction described in the present examples.

Figure 3:
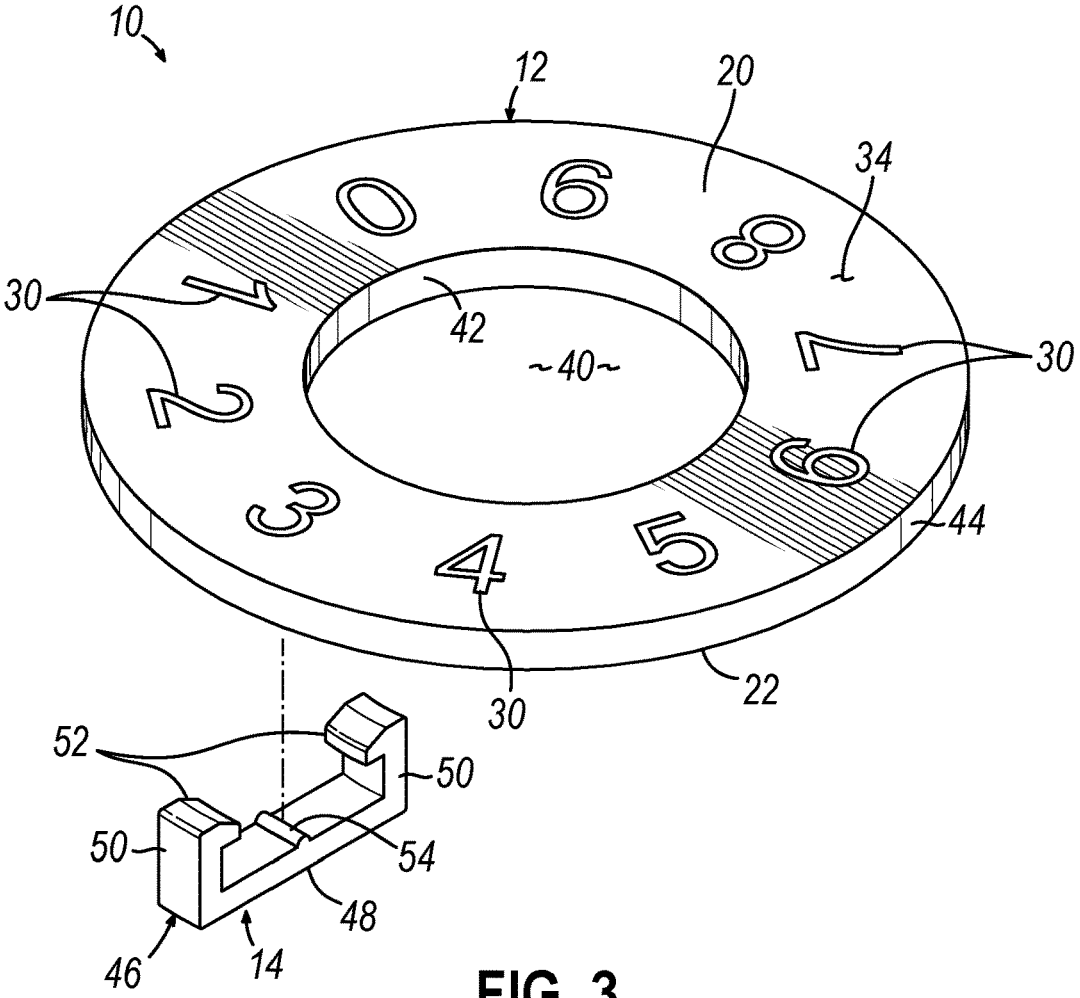
FIG. 3 depicts an exploded upper perspective view of the wear counter of FIG. 1.
Figure 4:
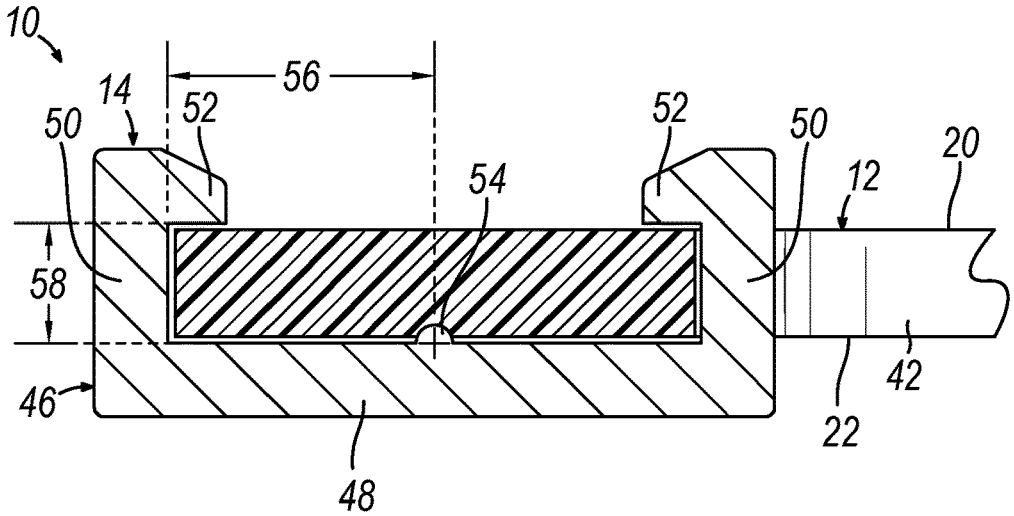
FIG. 4 depicts an enlarged cross-sectional view of the wear counter of FIG. 1 taken along section line 4-4 of FIG. 1.
Figure 5:
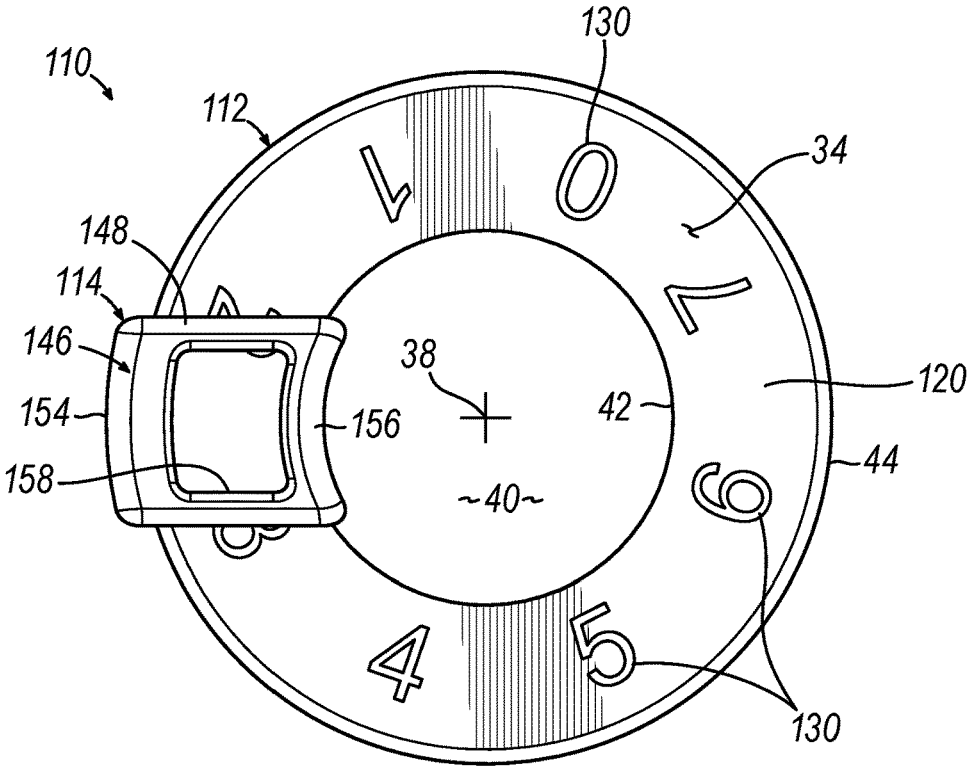
FIG. 5 depicts a front side elevational view of a second example of a wear counter having a second exemplary ring and a second exemplary slide.
Figure 6:
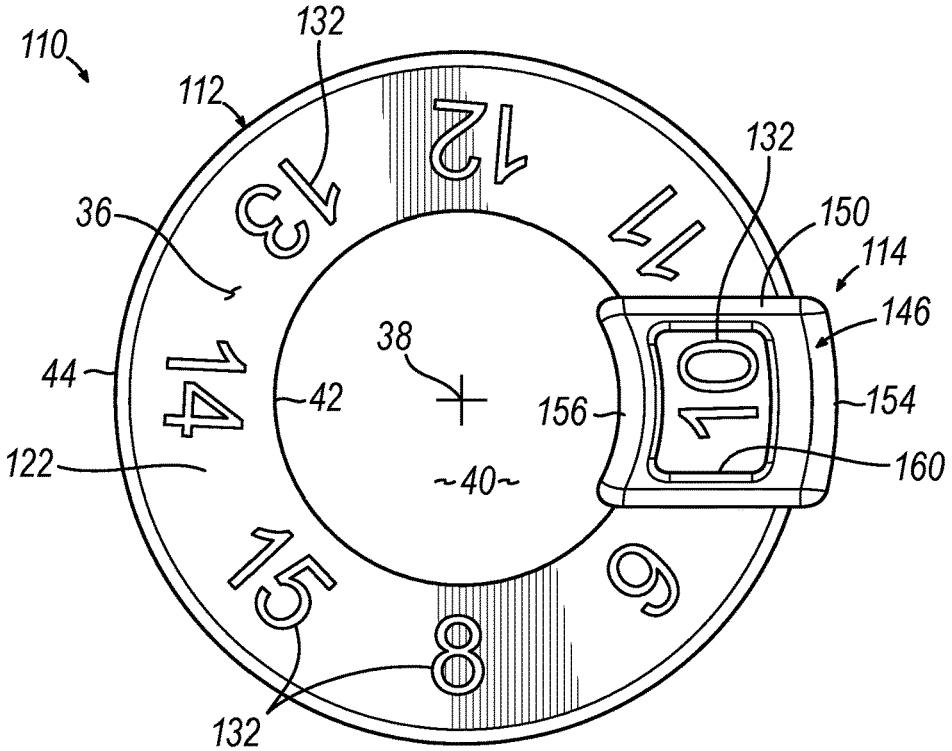
FIG. 6 depicts a rear side elevational view of the wear counter of FIG. 5.
Figure 7:
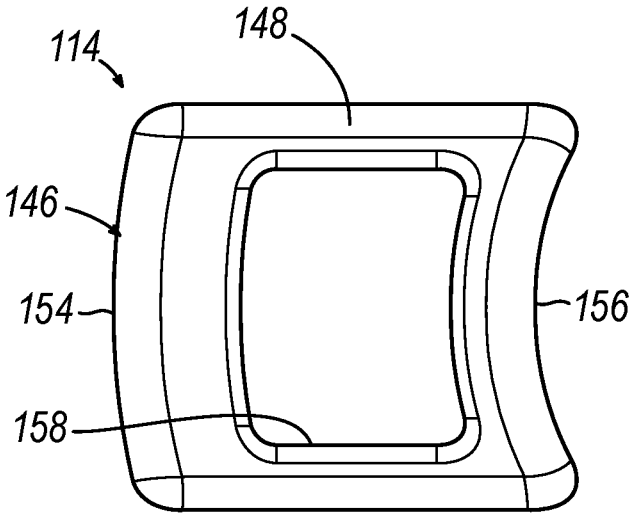
FIG. 7 depicts a front side elevational view of the slide of FIG. 5.
Figure 8:
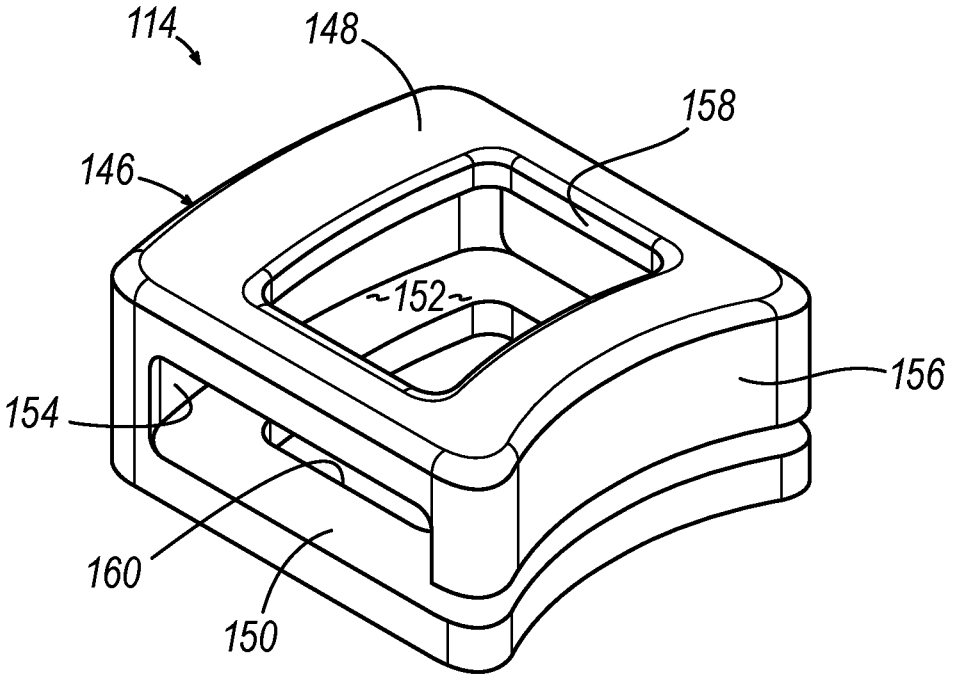
FIG. 8 depicts a perspective view of the slide of FIG. 5.

FIGS. 3-4 show slide indicator (14) slidably secured to ring body (12) in greater detail. To this end, ring body (12) includes a central opening (40) about central axis (38) and defines an inner radial surface (42) surrounding central opening (40) and an outer radial surface (44) about an outer circumference of ring body (12). Slide indicator (14) of the present example has a generally U-shaped slide body (46) include a base (48) and a pair of catch arms (50) each extending transversely from lateral end portions of base (48). Catch arms (50) are generally resilient and have hooked ends (52) opposite base (48) for deflecting about inner and outer radial surfaces (42, 44) of ring body (12) and snapping resiliently onto ring body (12). Base (48) also includes an inner crest (54) positioned against ring body (12) such that slide indicator (14) effectively transversely captures ring body (12) between hooked ends (52) and inner crest (54) while allowing for selective sliding of slide body (46) angularly about ring body (12) during use. In the present example, a lateral gap dimension (56) from inner crest (54) to catch arms (50) is approximately 0.145 inches, and a transverse gap dimension (58) from base (48) to hooked end (52) is approximately 0.065 inches, although such gap dimensions (56, 58) may vary to slidably capture ring body (12) to slide body (46) so as to allow for movement while generating sufficient friction to fix slide body (46) to ring body (12) when not being selectively manipulated by the user. In one example, wear counter (10) includes an auxiliary locking mechanism, such as a ratcheting pawl/rack locking mechanism, a snap-fit indent/detent locking mechanism, or any other suitable type of locking mechanism to assist in selectively securing slide indicator (14) at a desired angular position relative to ring body (12).

By way of example, selective angular alignment of slide indicator (14) with a like angular position of a desired indicia, such as any of front and rear indicia (30, 32) visually communicates the desired indicia for later viewing. More particularly, the integers of front indicia (30) are configured to be radially positioned between hooked ends (52) of slide indicator (14) (see FIG. 1), whereas letters of rear indicia (32) are configured to be at least partially covered by base (48) of slide indicator (14) (see FIG. 2). While such positioning of slide indicator (14) relative to indicia (30, 32) is shown in the present example, any selective positioning of slide indicator (14) relative to indicia (30, 32) desired by the user may be similarly used.

In still another example not shown in the present figures, a ring body (not shown) may have a plurality of indicia with additional numbers on one side thereof. Such an exemplary ring may include a plurality of slide bodies, such as a first slide body and a second slide body. The first and second slide bodies may be arranged together, such as hands on a clock dial, and provide for numbers "0" to "99". In any event, wear counter (10) provides an elegantly simple and robust solution for tracking a number of uses of an associated garment since the garment's most recent laundering. By including only two components, each of which is singularly and unitarily formed in the present example, and by being devoid of complex motors, transmissions, or other automation components or intricate moving parts, wear counter (10) may be easily and inexpensively manufactured, may be intuitively operated by the user, and even washed and dried in washer and dryer machine cycles without damaging wear counter (10). While the present example describes the use of wear counter (10) for tracking usage of garments, wear counter (10) is not intended to be unnecessarily limited to use with garment. To this end, wear counter (10) may be alternatively used more generally with any article for tracking an aspect to the article as desired by the user.

B. Second Example of a Wear Counter

FIGS. 5-8 show a second example of a wear counter (110) including a second exemplary, generally annular ring body (112) and a second exemplary slide indicator (114) selectively slidably coupled to ring body (112). Wear counter (110) is similar to wear counter (10) (see FIG. 1) to track a number of garment wears unless as otherwise described below such that like numbers below indicate like features discussed above in greater detail. To this end, ring body (112) of wear counter (110) includes front and rear sides (120, 122) having pluralities of front and rear indicia (130, 132) arranged on front and rear surfaces (34, 36), respectively. While ring body (112) has front and rear indicia (130, 132) respectively on both front and rear sides (120, 122), such indicia (130, 132) may only be on one of such sides (120, 122) in alterative examples. In the present example, the plurality of front indicia (130) includes eight integers from "0" to "7," inclusive, arranged with uniform circumferential spacing about central axis (38) of ring body (112) such that the integers increase incrementally in a counterclockwise direction. The plurality of rear indicia (132) includes eight integers from "8" to "15," inclusive, arranged with uniform circumferential spacing about central axis (38) of ring body (112) such that the integers increase incrementally in a counterclockwise direction. Such indicia (130, 132) may be printed on surfaces (34, 36), raised on surfaces (34, 36), or recessed relative to respective on surfaces (34, 36) on sides (120, 122). In the present example, front indicia (130) are angularly offset from, or misaligned with, rear indicia (132) such that each indicia (130, 132) occupies a respective, dedicated angular position on ring body (112) about the central axis (38) of ring body (112). Slide indicator (14) is configured to be selectively repositioned about central axis (38) to align with any of front and/or rear indicia (130, 132) as desired by the user. For example, the user may align slide indicator (14) with integers of front indicia (30) as a garment is worn to count up with each respective wear. By way of further example, the user may then align slide indicator (14) with integers of rear indicia (132) as a garment is worn to count up beyond the integers of front indicia (130) with each respective wear.

Ring body (112) of the present example is singularly and unitarily formed, such as via an injection molding process, for example. In one example, ring body (112) is constructed of a relatively lightweight non-absorbent and/or water-proof material, such as nylon, for example. Ring body (112) of the present example also has an outer diameter large enough to enable visibility of indicia (130, 132) yet small enough to be attached to garments, even while being worn relatively unnoticed by the user. Such an outer diameter of ring body (12) in one example ranges from approximately 0.75 inches to approximately 2.0 inches and, more particularly, from approximately 1 inch to approximately 1.5 inches, such as approximately 1.125 inches, although the invention is not intended to be unnecessarily limited to such sizing. Moreover, it will be appreciated that alternative methods of manufacture other than injection molding may be used, and the invention is not intended to be unnecessarily limited to any particular manufacturing technique or construction described in the present examples.

Slide indicator (114) has a slide body (146) with front and rear window frames (148, 150) transversely spaced apart from each other by a gap (152) substantially equal to a thickness of ring body (112) and connected to each other by a radially outer sidewall (154). Front window frame (148) transversely, which may also be referred to herein as axially, overlies at least a portion of front side (120) and rear window frame (150) transversely overlies at least a portion of rear side (122). In this regard, front and rear window frames (148, 150) are resiliently biased toward each other to frictionally engage and sandwich ring body (112) therebetween to assist in retaining slide body (146) on ring body (112). At least one of front and rear window frame (148, 150) include a catch prong (156) extending transversely to assist in preventing slide body (146) from being inadvertently dislodged from ring body (112), thereby capturing slide body (146) on ring body (112) while allowing for slidable movement of slide body (146) thereon. As shown, front and rear window frames (148, 150) define front and rear viewing apertures (158, 160), respectively, for allowing the user to observe a corresponding underlying front and/or rear indicia (130, 132) when slide body (146) is angularly aligned therewith. Slide indicator (114) of the present example is singularly and unitarily formed, such as via an injection molding process, for example. In one example, slide indicator (114) is constructed of a relatively lightweight non-absorbent and/or water-proof material, such as nylon, for example. Slide indicator (114) of the present example is also sized such that each of front and rear viewing apertures (158, 160) is configured to fully visually capture a single front or rear indicia (130, 132) when slide indicator (114) is angularly aligned therewith while excluding (at least partially) each of the remaining front and rear indicia (130, 132).

Slide indicator (114) is configured to be manually gripped and manipulated by the user to orbit about the central axis (38) of ring body (112) along the front and rear sides (120, 122) into selective angular alignment with each of the indicia (130, 132). When slide indicator (114) is angularly aligned with a selected front indicia (130) on front side (120), the selected front indicia (130) is observable through front viewing aperture (158). Similarly, when slide indicator (114) is angularly aligned with a selected rear indicia (132) on rear side (122), the selected rear indicia (132) is observable through rear viewing aperture (160). Due to the angular offset of front indicia (130) from rear indicia (132), slide indicator (114) is angularly alignable with either one of front indicia (130) or one of rear indicia (132), and is not simultaneously alignable with both one of front indicia (130) and rear indicia (132). Due to the sizing of front and rear viewing apertures (158, 160) relative to front and rear indicia (130, 132), only a single front or rear indicia (130, 132) is fully observable through one of front or rear viewing apertures (158, 160) when slide indicator (114) is at any given angular position. For example, slide indicator (114) is in a same angular position relative to ring body (112) in both FIGS. 5 and 6, such that only the integer "10" of rear indicia (132) is fully observable through rear viewing aperture (62), while no one of the integers of front indicia (130) is fully observable through front viewing aperture (158) (e.g., front viewing aperture (158) overlies a space between front indicia (130) including the integers "2" and "3"). Thus, the angular position of slide indicator (114) relative to ring body (112) is selectable to provide a visual indication of a selected number of uses, such as wears, of an associated garment.

Like slide indicator (14) (see FIG. 1) discussed above, slide indicator (114) is also configured to remain stationary relative to ring body (112) in the absence of a user-applied force on slide indicator (114) to reliably maintain slide indicator (114) at the selected angular position relative to ring body (112) until the user desires to move slide indicator (114) to a new angular position. For example, the frictional engagement between slide indicator (114) and ring body (112) is sufficient to resist inadvertent relative movement between slide indicator (114) and ring body (112) which might otherwise be caused by gravity or by movement of wear counter (110), such as while hanging from a garment. In one example, wear counter (110) includes an auxiliary locking mechanism, such as a ratcheting pawl/rack locking mechanism, a snap-fit indent/detent locking mechanism, or any other suitable type of locking mechanism to assist in selectively securing slide indicator (114) at a desired angular position relative to ring body (112).

In the example shown, slide indicator (114) is selectively movable between 16 discrete angular positions relative to ring body (112), including eight angular positions in which slide indicator (114) is radially alignable with any of front indicia (130) provided on front side (120) such that a selected integer from "0" to "7," inclusive, is observable through front viewing aperture (158), and eight angular positions in which slide indicator (114) is angularly alignable with any of rear indicia (132) provided on rear side (122) such that a selected integer from "8" to "15," inclusive, is observable through rear aperture (160). In this manner, the angular position of slide indicator (114) relative to ring body (112) is selectable to provide a visual indication that an associated garment has experienced any of between 0 to 15 uses since the garment's most recent laundering.

It will be appreciated that ring body (112) may include any suitable alternative number and/or arrangement of indicia (130, 132). For example, more or less of front and/or rear indicia (130, 132) may be provided to enable visual indications of more or less uses since an associated garment's most recent laundering. In one example, rear indicia (132) may be omitted such that only front indicia (130) are provided. In such cases, rear viewing aperture (160) may be omitted such that rear window frame (150) may comprise a solid panel.

In still another example not shown in the present figures, a ring body (not shown) may have a plurality of indicia with additional numbers on one side thereof. Such an exemplary ring body may include a plurality of slide indicators, such as a first slide indicator and a second slide indicator. The first and second slide bodies may be arranged together, such as hands on a clock dial, and provide for numbers "0" to "99". In any event, wear counter (110), like wear counter (10) discussed above, provides an elegantly simple and robust solution for tracking a number of uses of an associated garment since the garment's most recent laundering. By including only two components, each of which is singularly and unitarily formed in the present example, and by being devoid of complex motors, transmissions, or other automation components or intricate moving parts, wear counter (110) may be easily and inexpensively manufactured, may be intuitively operated by the user, and even washed and dried in washer and dryer machine cycles without damaging wear counter (110). While the present example describes the use of wear counter (110) for tracking usage of garments, wear counter (110) is not intended to be unnecessarily limited to use with garment. To this end, wear counter (110) may be alternatively used more generally with any article for tracking an aspect to the article as desired by the user.

II. Method of Tracking Use of a Garment with a Wear Counter

Figure 9:
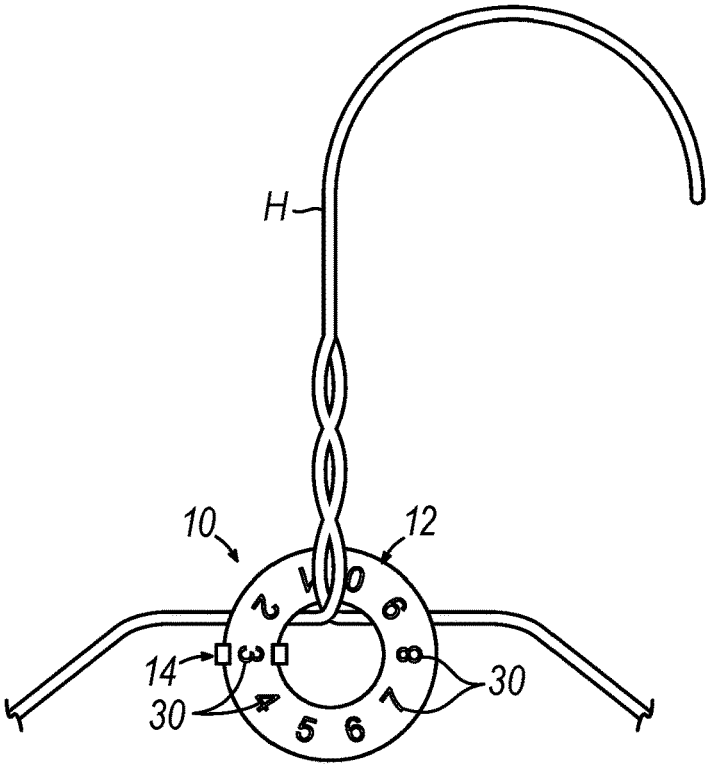
FIG. 9 depicts an enlarged front side elevational view of the wear counter of FIG. 1 selectively positioned on a clothes hanger.
Figure 10:
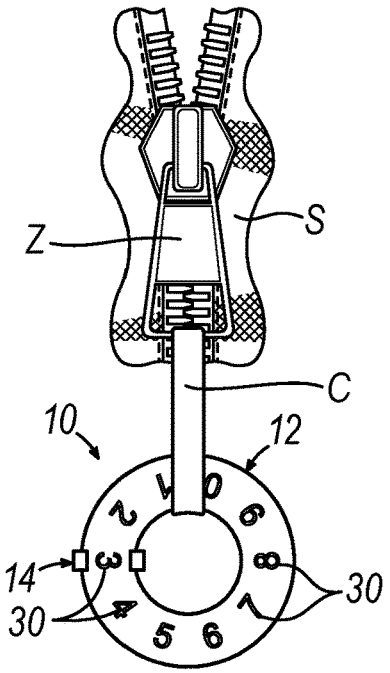
FIG. 10 depicts an enlarged front side elevational view of the wear counter of FIG. 1 selectively positioned on a zipper of a garment via a clip.
Figure 11:
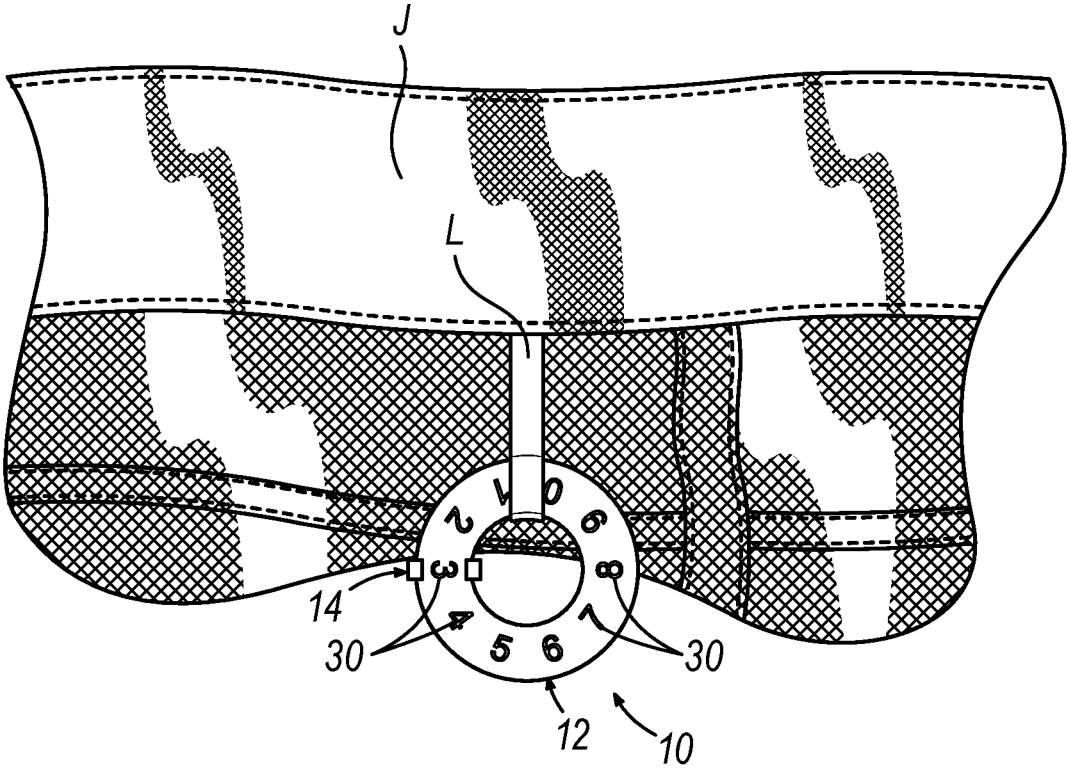
FIG. 11 depicts an enlarged front side elevational view of the wear counter of FIG. 1 affixed to a garment via a sewn-in loop.

Referring now to FIGS. 9-11, the user operates wear counters (10, 110) by applying wear counters (10, 110) to track a number of uses, which may also be referred to herein as wears, of an associated garment since the garment's most recent laundering in order to assist the user in determining when the garment is ready for laundering. The following will discuss these particular exemplary uses with reference to wear counter (10) discussed above, but such exemplary uses may be similarly performed with wear counter (110) (see FIG. 5). The uses are thus not intended to be unnecessarily limited to wear counter (10).

As shown in FIG. 9, the user selectively positions wear counter (10) about a neck of a clothes hanger (H) that is supporting an associated garment (not shown), such as pants. In this example, the pants are associated with wear counter (10) via clothes hanger (H). After each wear of the pants, the user may return the pants to hanger (H) and incrementally adjust the angular position of slide indicator (14) relative to ring body (12) to select an integer from "0" to "9," inclusive, corresponding to the number of wears of pants since pants were most recently laundered. For example, the user may perform a first laundering of pants, place pants on hanger (H), and manually set the angular position of slide indicator (14) relative to ring body (12) to select the integer "0" prior to any wears of pants following the first laundering to indicate that pants have not experienced any wears since pants were most recently laundered. After the first wear of pants following the first laundering, the user may return pants to hanger (H) and manually adjust the angular position of slide indicator (14) relative to ring body (12) to select the integer "1" to indicate that pants have experienced one wear since pants were most recently laundered. After subsequent wears of pants following the first laundering, the user continues to manually adjust the angular position of slide indicator (14) relative to ring body (12) to incrementally increase the selected integer in accordance with the number of wears. In the illustrated example, the angular position of slide indicator (14) relative to ring body (12) selecting the integer "3" indicates that pants have experienced three wears since pants were most recently laundered. When the selected integer reaches the user's desired threshold number of wears since pants were most recently laundered, the user may perform a second laundering of pants, place pants on hanger (H), and manually reset the angular position of slide indicator (14) relative to ring body (12) to select the integer "0" prior to any wears of pants following the second laundering to indicate that pants have not experienced any wears since pants were most recently laundered, and the cycle may be repeated to continually track wears of pants and schedule subsequent launderings throughout the useful life of pants.

In some cases, the user may choose to perform an unscheduled laundering of pants (e.g., prior to reaching the user's desired threshold), such as after a wear in which pants were exposed to a particularly high degree of dirt, sweat, or other sources of stains and micro-organisms. In such cases, the user may perform such an unscheduled laundering of pants, place pants on hanger (H), and manually reset the angular position of slide indicator (14) relative to ring body (12) to select the integer "0" prior to any wears of pants following the unscheduled laundering to indicate that pants have not experienced any wears since pants were most recently laundered, thereby maintaining the tracking cycle.

As shown in FIG. 10, the user selectively couples wear counter (10) to a zipper (Z) of an associated garment, such as a sweater (S) via a clip (C). In this example, sweater (S) is associated with wear counter (10) via a clip (C). While clip (C) is shown in the form of a binder clip (C), any other suitable type of clip may be used to selectively and removably couple wear counter (10) to sweater (S). Moreover, while clip (C) is shown selectively coupling wear counter (10), clip (C) may selectively couple wear counter (10) to any other suitable portion of sweater (S), such as a tag, a sleeve, or a collar of sweater (S). In one example, the user may selectively un-clip wear counter (10) from sweater (S) prior to each wear of sweater (S) and/or prior to each laundering of sweater (S).

After each wear of sweater (S), the user may re-clip wear counter (10) to sweater (S) and incrementally adjust the angular position of slide indicator (14) relative to ring body (12) to select an integer from "0" to "9," inclusive, corresponding to the number of wears of sweater (S) since sweater (S) was most recently laundered, in a manner similar to that described above with regard to pants in connection with FIG. 9. In the illustrated example of FIG. 10, the angular position of slide indicator (14) relative to ring body (12) selecting the integer "3" indicates that sweater (S) has experienced three wears since sweater (S) was most recently laundered.

As shown in FIG. 11, wear counter (10) is fixedly coupled to an associated garment, such as pants, more particularly in the form of jeans (J) via a sewn-in loop (L). In this example, jeans (J) are associated with wear counter (10) via loop (L). Since wear counter (10) may be relatively lightweight and non-absorbent/water-proof, wear counter (10) may remain fixedly coupled to jeans (J) during each wear of jeans (J) without causing any discomfort to the user, and thus remain fixedly coupled to jeans (J) during each laundering of jeans (J) without causing any damage to wear counter (10). Such fixed coupling of wear counter (10) to jeans (J) may ensure that a proper association is maintained between wear counter (10) and jeans (J) to prevent wear counter (10) from being inadvertently associated with a different garment.

After each wear of jeans (J), the user may incrementally adjust the angular position of slide indicator (14) relative to ring body (12) to select an integer from "0" to "9," inclusive, corresponding to the number of wears of jeans (J) since jeans (J) were most recently laundered, in a manner similar to that described above with regard to pants in connection with FIG. 4. In the illustrated example of FIG. 11, the angular position of slide indicator (14) relative to ring body (12) selecting the integer "3" indicates that jeans (J) have experienced three wears since jeans (J) were most recently laundered.

While wear counter (10) is described herein as being used to track a number of wears of an associated garment since the garment's most recent laundering by "counting up", it will be appreciated that wear counter (10) may be used in an inverse manner to track a remaining number of wears of the garment before the garment's next desired laundering. In other words, the wear counter (10) may be used to provide a visual "countdown" by incrementally decreasing the selected integer after each wear of the associated garment until the selected integer is "0," thereby indicating that the garment is ready for laundering. Similarly, the above description of counting up and the countdown may apply to tracking the calendar days of the week with respect to the letters of rear indicia (32). The invention is thus not intended to be unnecessarily limited to a particular form of tracking such that the user may incorporate additional or alternative methods of tracking use as desired from garment to garment.

III. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A method of tracking wear of a garment with a device, the device including a counter body and an indicator, the counter body having a first indicia and a second indicia thereon, the indicator movably connected to the counter body and configured to be selectively positioned relative to each of the first indicia and the second indicia for selectively aligning the indicator relative to the first indicia or the second indicia, wherein the first indicia is different than the second indicia such that the indicator in alignment with the first indicia is configured to communicate a first wear state of the garment to a user and the indicator in alignment with the second indicia is configured to communicate a second wear state of the garment to the user, the method comprising: selectively moving the indicator into alignment with the first indicia thereby tracking the first wear state of the garment.

Example 2

The method of Example 1, further comprising selectively moving the indicator from alignment with the first indicia into alignment with the second indicia thereby tracking the second wear state of the garment.

Example 3

The method of any one or more of Example 1 through Example 2, further comprising communicating the first wear state of the garment to the user.

Example 4

The method of any one or more of Example 1 through Example 3, further comprising associating the device with the garment.

Example 5

The method of Example 4, wherein associating the device with the garment further includes securing the device relative to the garment.

Example 6

The method of Example 5, wherein securing the device relative to the garment further includes attaching the device to the garment.

Example 7

The method of Example 6, further comprising simultaneously laundering the garment and the device.

Example 8

The method of Example 6, further comprising: removing the device from the garment; and laundering the garment without the device.

Example 9

The method of Example 4, wherein associating the device with the garment further includes attaching the device to a structure configured to support the garment thereon.

Example 10

The method of Example 9, wherein the structure is a hangar configured to receive the garment thereon for storage.

Example 11

The method of any one or more of Example 1 through Example 10, wherein the counter body is a counter ring body having an annular shape, and wherein selectively moving the indicator of the device into alignment with the first indicia further includes sliding the indicator about a central axis defined by the counter ring body into alignment with the first indicia.

Example 12

The method of Example 11, further comprising receiving the first indicia between at least two portions of the indicator such that the first indicia remains uncovered by the indicator when aligned with the first indicia.

Example 13

The method of Example 11, further comprising receiving the first indicia against at least a portion of the indicator such that at least a portion of the first indicia is covered by the indicator when aligned with the first indicia.

Example 14

The method of any one or more of Example 1 through Example 13, wherein the first wear state is a less worn state of garment wear by the user, and wherein the second wear state is a more worn state of garment wear by the user.

Example 15

The method of any one or more of Example 1 through Example 14, wherein the counter body is singularly and unitarily formed, and wherein the indicator is singularly and unitarily formed.

Example 16

The method of Example 15, wherein the device includes only the counter body and the indicator.

Example 17

A device for tracking wear of a garment, comprising: a counter body having a first indicia and a second indicia thereon, wherein the counter body is singularly and unitarily formed; and an indicator movably connected to the counter body and configured to be selectively positioned relative to each of the first indicia and the second indicia for selectively aligning the indicator relative to the first indicia or the second indicia, wherein the indicator is singularly and unitarily formed, wherein the first indicia is different than the second indicia such that the indicator in alignment with the first indicia is configured to communicate a first wear state of the garment to a user and the indicator in alignment with the second indicia is configured to communicate a second wear state of the garment to the user.

Example 18

A device for tracking wear of a garment, comprising: an annular counter ring body, including: a first side having a first plurality of indicia thereon, wherein the first plurality of indicia includes a first indicia and a second indicia, and an opening about a central axis, wherein the first plurality of indicia on the first side are angularly positioned about the opening; and an indicator slidably connected to the annular counter ring body and configured to be selectively and angularly positioned about the central axis relative to each of the first indicia and the second indicia for selectively aligning the indicator relative to the first indicia or the second indicia, wherein the first indicia is different than the second indicia such that the indicator in alignment with the first indicia is configured to communicate a first wear state of the garment to a user and the indicator in alignment with the second indicia is configured to communicate a second wear state of the garment to the user.

Example 19

The device of Example 18, wherein the indicator includes a slide body having a base and a pair of resilient catch arms, wherein each of the pair of resilient catch arms extends from the base capturing the indicator to the annular counter ring body while allowing for selective movement of the indicator relative to the annular counter ring body.

Example 20

The device of any one or more of Example 18 through Example 19, wherein the annular counter ring body is singularly and unitarily formed, and wherein the indicator is singularly and unitarily formed.

Example 21

A wear counter, comprising: a ring including a first side having a plurality of first indicia arranged with uniform circumferential spacing about a central axis of the ring; and a slide including a first window frame defining a first aperture, wherein the slide is slidably coupled with the ring such that the slide is selectively angularly alignable with each of the first indicia, wherein each of the first indicia is observable through the first aperture when angularly aligned with the slide.

Example 22

The wear counter of Example 21, wherein the ring includes a second side having a plurality of second indicia arranged with uniform circumferential spacing about the central axis of the ring, wherein the slide includes a second window frame defining a second aperture, wherein the slide is selectively angularly alignable with each of the second indicia, wherein each of the second indicia is observable through the second aperture when angularly aligned with the slide.

Example 23

The wear counter of any one or more of Example 21 through Example 22, wherein the plurality of first indicia are angularly offset from the plurality of second indicia relative to the central axis of the ring.

Example 24

The wear counter of any one or more of Example 21 through Example 23, wherein at least one of the ring or the slide is singularly and unitarily formed.

Example 25

The wear counter of any one or more of Example 21 through Example 24, wherein at least one of the ring or the slide is constructed of a material that is at least one of non-absorbent or waterproof.

Example 26

The wear counter of any one or more of Example 21 through Example 25, wherein each of the first indicia includes an integer.

Example 27

The wear counter of Example 26, wherein the integers increase incrementally in at least one of a clockwise or a counterclockwise direction.

Example 28

The wear counter of Example 26, wherein a lowest integer of the integers is 0.

Example 29

The wear counter of any one or more of Example 21 through Example 28, wherein the slide is configured to be manually slid by a user relative to the ring.

Example 30

The wear counter of any one or more of Example 21 through Example 29, wherein the slide is configured to frictionally engage the ring to selectively secure an angular position of the slide relative to the ring.

IV. Miscellaneous

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A method of tracking wear of a garment with a device, the device including a counter body and an indicator, the counter body having a first indicia and a second indicia thereon, the indicator movably connected to the counter body and configured to be selectively positioned relative to each of the first indicia and the second indicia for selectively aligning the indicator relative to the first indicia or the second indicia, wherein the first indicia is different than the second indicia such that the indicator in alignment with the first indicia is configured to communicate a first wear state of the garment to a user and the indicator in alignment with the second indicia is configured to communicate a second wear state of the garment to the user, wherein the counter body is a counter ring body having an annular shape, wherein the counter ring body includes a first side, a second side opposite the first side, an inner radial surface, and an outer radial surface, and wherein the indicator overlies the first side, the second side, the inner radial surface, and the outer radial surface such that the indicator is captured on the counter ring body, the method comprising:

attaching the device to the garment;

wearing of the garment by the user such that the device remains coupled to the garment while wearing; and selectively moving the indicator into alignment with the first indicia thereby tracking the first wear state of the garment, and wherein selectively moving the indicator of the device into alignment with the first indicia further includes sliding the indicator about a central axis defined by the counter ring body into alignment with the first indicia.

2. The method of claim 1, further comprising simultaneously laundering the garment and the device.

3. The method of claim 1, further comprising:

removing the device from the garment; and laundering the garment without the device.

4. The method of claim 1, further comprising receiving the first indicia between at least two portions of the indicator such that the first indicia remains uncovered by the indicator when aligned with the first indicia.

5. The method of claim 1, further comprising receiving the first indicia against at least a portion of the indicator such that at least a portion of the first indicia is covered by the indicator when aligned with the first indicia.

6. The method of claim 1, wherein the counter body is singularly and unitarily formed, and wherein the indicator is singularly and unitarily formed.

7. The method of claim 6, wherein the device includes only the counter body and the indicator.

8. The method of claim 1, wherein attaching the device to the garment further includes fixedly coupling the device to the garment.

9. A device for tracking wear of a garment, consisting essentially of:

a counter body having a first indicia and a second indicia thereon, wherein the counter body is singularly and unitarily formed; and an indicator movably connected to the counter body and configured to be selectively positioned relative to each of the first indicia and the second indicia for selectively aligning the indicator relative to the first indicia or the second indicia, wherein the indicator is singularly and unitarily formed, wherein the first indicia is different than the second indicia such that the indicator in alignment with the first indicia is configured to communicate a first wear state of the garment to a user and the indicator in alignment with the second indicia is configured to communicate a second wear state of the garment to the user, wherein the counter body is a counter ring body having an annular shape, wherein the counter ring body includes a first side, a second side opposite the first side, an inner radial surface, and an outer radial surface, and wherein the indicator overlies the first side, the second side, the inner radial surface, and the outer radial surface such that the indicator is captured on the counter ring body.

10. The device of claim 9, wherein the counter ring body defines an outer diameter from approximately 0.75 inches to approximately 2.0 inches for enabling visibility and being attached to the garment during use.

11. The device of claim 10, wherein each of the annular counter ring body and the indicator is formed of at least one non-absorbent material.

12. The device of claim 9, further comprising a garment, wherein the counter body is fixedly coupled to the garment.

13. A device for tracking wear of a garment, comprising:

an annular counter ring body, including:

a first side having a first plurality of indicia thereon, wherein the first plurality of indicia includes a first indicia and a second indicia, a second side opposite the first side, an inner radial surface, an outer radial surface, and an opening about a central axis, wherein the first plurality of indicia on the first side are angularly positioned about the opening; and an indicator slidably connected to the annular counter ring body and configured to be selectively and angularly positioned about the central axis relative to each of the first indicia and the second indicia for selectively aligning the indicator relative to the first indicia or the second indicia, wherein the indicator overlies the first side, the second side, the inner radial surface, and the outer radial surface such that the indicator is captured on the annular counter ring body, wherein the first indicia is different than the second indicia such that the indicator in alignment with the first indicia is configured to communicate a first wear state of the garment to a user and the indicator in alignment with the second indicia is configured to communicate a second wear state of the garment to the user.

14. The device of claim 13, wherein the indicator includes a slide body having a base and a pair of resilient catch arms, wherein each of the pair of resilient catch arms extends from the base capturing the indicator to the annular counter ring body while allowing for selective movement of the indicator relative to the annular counter ring body.

15. The device of claim 13, wherein each of the annular counter ring body and the indicator is formed of at least one non-absorbent material.

16. The device of claim 15, wherein the annular counter ring body defines an outer diameter from approximately 0.75 inches to approximately 2.0 inches for enabling visibility and being attached to the garment during use.

17. The device of claim 13, further comprising a garment, wherein the counter body is fixedly coupled to the garment.

* * * * *